United States Patent [19]

Kuang-Wu

[11] Patent Number: 4,791,690

[45] Date of Patent: Dec. 20, 1988

[54] COMBINATION DRILL BIT AND SOCKET DRIVE ASSEMBLY

[76] Inventor: Huang Kuang-Wu, No. 84 Syh Wei Rd., Syhr Guei Li, Doou Nan Jenn, Yun Lin Shiann, Taiwan

[21] Appl. No.: 39,694

[22] Filed: Apr. 20, 1987

[51] Int. Cl.[4] ..... B25F 3/00

[52] U.S. Cl. ..... 7/138; 7/158; 7/165; 81/437

[58] Field of Search ..... 7/138, 165, 158; 81/28, 81/437

[56] References Cited

U.S. PATENT DOCUMENTS

| | | | |
|---|---|---|---|
| 3,932,904 | 1/1976 | Nilsson et al. | 7/165 |
| 3,965,510 | 6/1976 | Ernst | 7/165 |
| 4,551,875 | 11/1985 | Getz et al. | 7/138 |

*Primary Examiner*—Roscoe V. Parker

*Attorney, Agent, or Firm*—Bacon & Thomas

[57] ABSTRACT

An assembly including a drill bit carried by a drill shaft and a detachable main socket for use in conjunction with an electric drill to permit combination power drilling and power socket driving functions. A crank provided with a secondary socket is engageable with the drill shaft to permit manual driving of the main socket.

3 Claims, 3 Drawing Sheets

COMBINATION DRILL BIT AND SOCKET DRIVE ASSEMBLY

BACKGROUND OF THE INVENTION

1. Field of the Invention

The invention generally involves the field of technology pertaining to multi-purpose cement bits. More particularly, the invention relates to an improved cement bit for providing the combination functions of power drilling and power socket driving.

2. Description of the Prior Art

It is known to attach an article onto a wall surface, such as a billboard, aluminum surface, metal window and the like, wherein an electric drill is first used to drill an appropriate hole at the chosen position on the wall surface. A wall bracket is then secured to the wall surface by means of a fastener that is inserted through the hole and expanded with a wrench or similar tool. This method requires not only the use of different tools, which must be changed frequently, but also the necessity of releasing the electric drill in order to permit manual operation of the wrench. Accordingly, this procedure is inconvenient and causes a waste of time.

It is further known to provide a drill bit for attachment to a reversible electric drill for the purpose of drilling holes. The electric drill can also be used to tighten nuts by the addition of special tools, whereby the reversible function of the drill is effective for removing nuts which are tightly secured due to rust or other conditions.

These known devices are complicated, expensive and inefficient in use. Moreover, a conventional drill bit is normally thrown away when it is worn out since it is incapable of any function other than drilling holes.

SUMMARY OF THE INVENTION

It is an object of the invention to provide a simple and effective multi-purpose cement drill assembly that includes a drill shaft provided with a drill bit which may be used for drilling holes, and a main socket engageable with the drill shaft for permitting the tightening and loosening of nuts. The assembly is utilized in conjunction with an electric drill to permit power drilling and power socket driving, a combination of functions which can be performed without requiring the operator to release the electric drill or drill shaft, thus affording an efficient and cost-saving means for performing both power drilling and power socket driving.

It is another object of the invention to provide a drill assembly which also permits manual socket driving by providing a crank handle engageable with the drive shaft in the event electricity is not available to power the electric drill or if the working space constrains socket driving to a manual operation.

Other objects, advantages and features of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
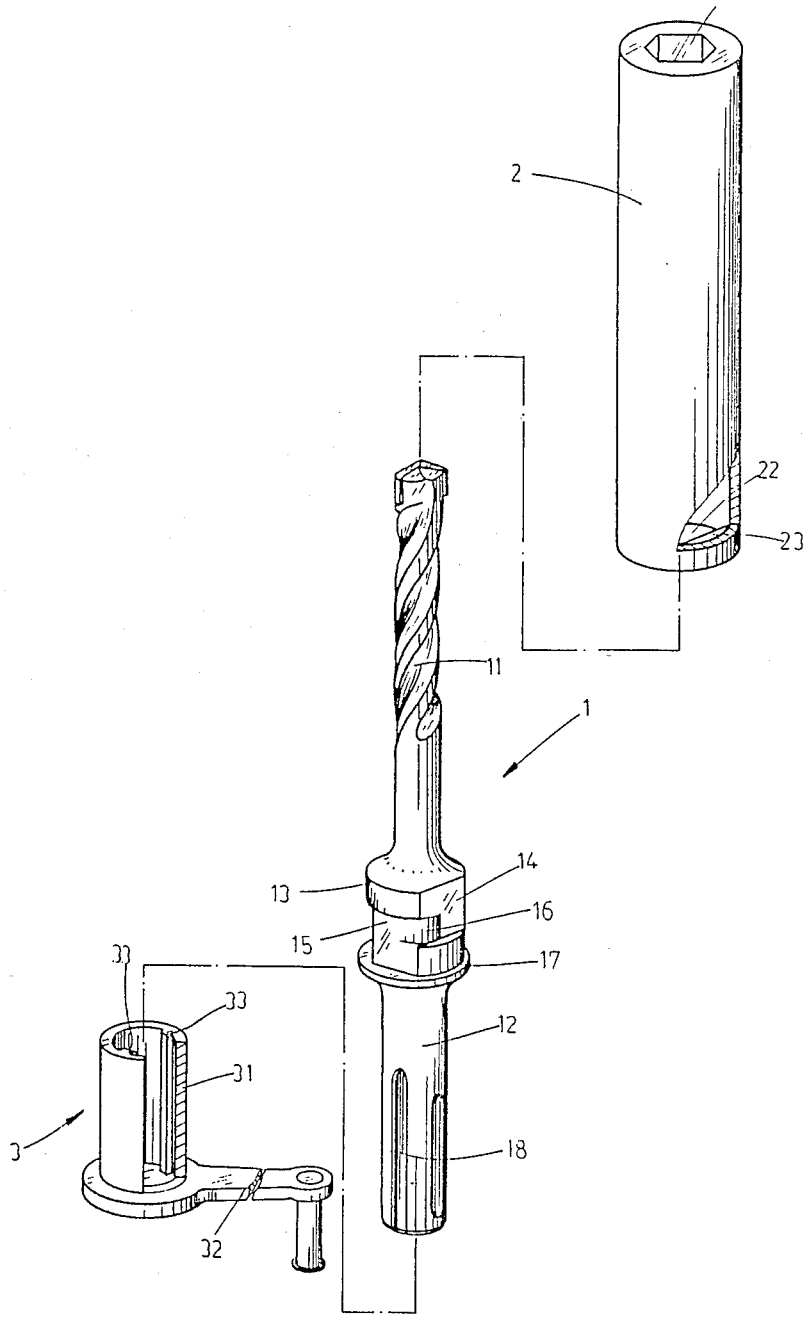
FIG. 1 is an exploded perspective view of an assembly according to a preferred embodiment of the invention and depicting the crank handle, the drill shaft and the main socket forming the assembly.

An assembly according to a preferred embodiment of the invention shall now be described with initial reference to FIG. 1. As shown therein, the assembly includes a drill shaft 1, a main socket 2 and a manual crank 3.

Drill shaft 1 includes a drill bit 11 at its front end and a rear section 12. Rear section 12 is configured for attachment to the chuck of a conventional drill and is also provided with a plurality of longitudinally extending grooves 18 for a purpose to be later described. The intermediate portion of drill shaft 1 between drill bit 11 and rear section 12 is configured to include a circular shoulder 13 which terminates in a first flat wall 14. Below shoulder 13 is provided a second flat wall 15, the lowermost portion of which terminates at a circular flange 17. First flat wall 14 transitions into second flat wall 15 through a radiused transition wall 16 disposed intermediate the top of shoulder 13 and flange 17. The planes defined by first flat wall 14 and second flat wall 15 intersect with each other at a ninety degree angle. The width of transition wall 16 is one-third the distance from the bottom of flat wall 15 to the top of shoulder 13. Second flat wall 15 extends for two-thirds the distance from circular flange 17 to the top of shoulder 13.

Main socket 2 is provided with an appropriately configured seat 21 at one end for engaging a nut. The other end of main socket 2 is provided with a D-shaped recess 22, the straight side of which is defined by a straight wall surface 23. As is apparent, main socket 2 is assembled onto drill shaft 1 by inserting drill bit 11 through recess 22 so that straight wall surface 23 is caused to engage first flat wall 14. Main socket 2 is then rotated ninety degrees to position straight wall surface 23 around transition wall 16 and into engagement with second flat wall 15. Thereafter, straight wall surface 23 is slid downwardly and engages the lowermost portion of flat wall 15, with the corresponding end of main socket 2 being disposed in abutting engagement with flange 17. The presence of shoulder 13 prevents removal of main socket 2 and flat wall 15 prevents rotation of main socket 2 during use. Removal of main socket 2 from drill shaft 1 is accomplished by reversing the attachment sequence, wherein main socket 2 is first pulled outwardly and thereafter rotated ninety degrees away from shoulder 13.

Figure 2:
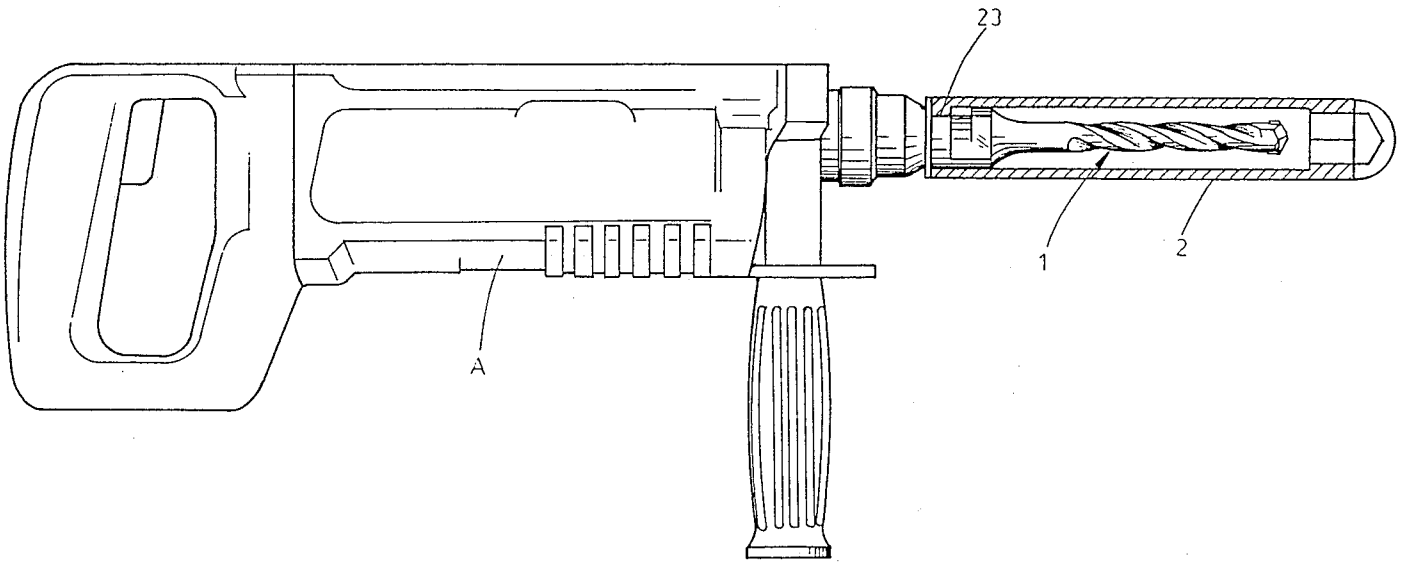
FIG. 2 is an elevational view showing the drill shaft and main socket of the assembly mounted to a conventional electric drill.
Figure 3:
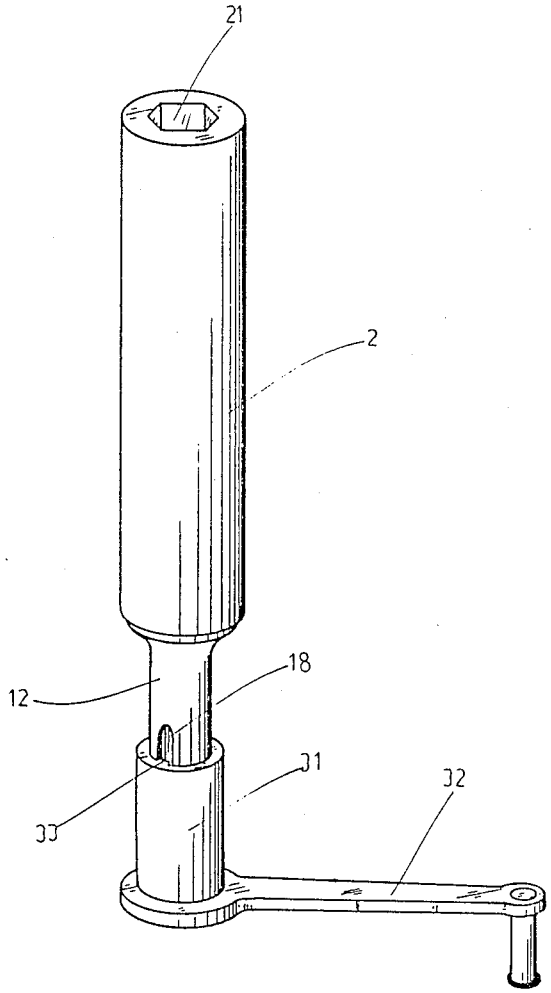
FIG. 3 is a perspective view showing the assembly of FIG. 1 in its assembled form for manual socket driving.

Drill shaft 1 is attached to a conventional electric drill by inserting rear section 12 and securing same to the drill chuck, as shown in FIG. 2. Operation of the electric drill permits power drilling holes with drill bit 11 or power socket driving with main socket 2 for removing or attaching nuts. However, in the event electricity is not available to power the electric drill or the workspace is limited, a manual crank 3 is provided. As seen in FIG. 1, manual crank 3 includes a crank handle 32 and a secondary socket 31 provided with plural opposed longitudinal ribs 33. Crank 3 is attached to rear section 12 by longitudinally engaging ribs 33 within grooves 18. This assembly is shown in FIG. 3 and therefore permits the use of manual crank 3 to manually loosen or tighten nuts by means of main socket 2.

Although the invention has been described and illustrated with reference to a preferred embodiment thereof, those skilled in the art will appreciate that various modifications, changes, additions, and substitutions may be made without departing from the spirit of the invention or scope of the subjoined claims.

I claim:

1. A combination drill and socket drive assembly comprising:

(a) a drill shaft including a front drill bit for drilling a hole, a rear section for attachment to the chuck of an electric drill and an intermediate section;

(b) a main socket for enclosing the drill bit, the main socket being provided with a seat at one end for engaging a nut and a D-shaped recess at the other end;

(c) the intermediate section including means permitting detachable engagement of the main socket to the drill shaft, whereby the main socket is engaged to the drill shaft when the assembly is used for socket driving a nut and the main socket is completely removed from the drill shaft when the drill bit is used for drilling a hole;

(d) a crank for permitting manual rotation of the drill shaft; and (e) the crank and rear section being provided with cooperating detachable engagement means.

2. The assembly of claim 1 wherein the detachable engagement means of the intermediate section includes a first flat wall, a second flat wall, a radiused transition wall joining the first and second flat walls, wherein the D-shaped recess of the main socket includes a straight wall surface for sequential engagement with the first and second flat walls of the intermediate section, and a circular flange carried by the drill shaft for abutting engagement by the other end of the main socket when the main socket is fully engaged with the intermediate section.

3. The assembly of claim 1 wherein the crank includes a handle and a secondary socket, and the cooperating detachable engagement means includes a plurality of grooves formed in the rear section of the drill shaft and a plurality of corresponding ribs formed in the secondary socket.

* * * * *